United States Patent [19]

Saukkonen

[11] Patent Number: 5,016,831

[45] Date of Patent: May 21, 1991

[54] METHOD AND DEVICE FOR THREADING THE END OF A WEB

[75] Inventor: Seppo Saukkonen, Vantaa, Finland

[73] Assignee: Valmet Paper Machinery Inc., Helsinki, Finland

[21] Appl. No.: 526,547

[22] Filed: May 17, 1990

Related U.S. Application Data

[63] Continuation of Ser. No. 398,327, Aug. 23, 1989, abandoned, which is a continuation of Ser. No. 194,470, May 16, 1988, abandoned.

[30] Foreign Application Priority Data

May 20, 1987 [FI] Finland ..... 872222

[51] Int. Cl.[5] ..... B65H 19/28; B65H 20/16

[52] U.S. Cl. ..... 242/55; 226/92; 242/56 R

[58] Field of Search ..... 242/55, 56 R, 56 A, 242/56 B, 65, 66, 56.2, 56.4, 56.6, 76, 195; 226/91, 92

[56] References Cited

U.S. PATENT DOCUMENTS 4,444,360 4/1984 Kaipf et al. ..... 242/56 R 4,491,503 1/1985 Adams et al. ..... 226/92

4,637,566 1/1987 Kyytsonen ..... 242/56 R

*Primary Examiner*—Stanley N. Gilreath

*Attorney, Agent, or Firm*—Dellett, Smith-Hill and Bedell

[57] ABSTRACT

The invention concerns a method and a device for threading the end of a web (P) from a jumbo roll (30) or equivalent through the winder along a path determined by the members guiding the web (P). In the method the end of the web (P) is passed from the jumbo roll (30) through the winder as of full width by grasping the end of the web (P) placed on the jumbo roll by means of a fetching and grasping device (11). The web (P) is transferred by means of the fetching and grasping device (11) to a web (P) holding device (13), the web (P) is held by means of the web (P) holding device (13), the web (P) is detached from the fetching and grasping device (11), the web (P) is attached to a threading member (22) carried by a carrier device (12), the web (P) is detached from the web (P) holding device (13), and the web (P) is threaded as a single thickness through the winder, whereat web (P) is unwound from the jumbo roll (30). The web (P) is cut off before the web (P) is attached to the threading member (22) carried by the carrier device (12).

20 Claims, 1 Drawing Sheet

METHOD AND DEVICE FOR THREADING THE END OF A WEB

This is a continuation of application Ser. No. 07/398,327 filed Aug. 27, 1989 and now abandoned, which is a continuation of application Ser. No. 07/194,470 filed May 16, 1988 and now abandoned.

The invention concerns a method for threading the end of a web from a jumbo roll or equivalent through the winder along a path determined by the members guiding the web, in which said method the end of the web is passed from the jumbo roll through the winder at full width by grasping the end of the web on the jumbo roll by means of a fetching and grasping device.

The invention also concerns a device for threading the end of a web from a jumbo roll or equivalent through the winder along a path determined by the members guiding the web, which said device includes a fetching and grasping device, which is fitted so as to grasp the end of the web on the jumbo roll.

At present, the threading of the end of the web is carried out so that the end of the web is torn to a wedge-shaped form and is passed by means of the threading equipment through the winder, e.g. in a carrier-drum slitter-winder, onto the carrier drums. Thereupon the wedge-shaped end of the web is removed, and the slit component webs are wound around paper cores in known manner art before the winding is started. It is a drawback of this method that the threading of the web is very slow and, as a rule, requires 2 or 3 workers, because the end of the web must first be torn to a wedge-shaped form, the creeping of the winder device, such as, e.g., a slitter-winder, is slow, and the removal of the wedge-shaped end takes time. Moreover, the prior-art method requires air blowers, belts, etc. as auxiliary equipment for the threading of the web.

In the Finnish Patent No. 69,439, a method and a device are described for threading the end of a web from a jumbo roll or equivalent through the winder along a path determined by the members guiding the web. In this prior-art solution, the end of the web is passed from the jumbo roll through the winder at full width by grasping the end of the web placed on the jumbo roll and winding the web around a fetching and grasping device for a desired number of revolutions, whereupon the web is passed through the winder in doubled over fashion so that web is unwound at the same time both from the jumbo roll and from the fetching and grasping device.

Among other things, a drawback of the method and the device in accordance with the Finnish Patent No. 69,439 is that the bottom layers formed on the paper core constitute material unsuitable for printing, for which reason the roll cannot be unwound completely to the end. This causes a certain loss of material. Moreover, this prior-art method and device require a relatively complicated solution of equipment, because the web must be passed through the winder as two-fold.

The object of the invention is to provide an improvement of the methods known in prior art and, above all, to improve the method of the Finnish Patent No. 69,439. A more specific object of the invention is to provide a method wherein the threading of the end of the web can be made faster while, at the same time, reducing the number of components in the equipment needed for the threading.

The objectives of the invention are achieved by means of a method which is mainly characterized in that the web is transferred by means of the fetching and grasping device to a web holding device, the web is held by means of the web holding device, the web is detached from the fetching and grasping device, the web is attached to a threading member carried by a carrier device, the web is detached from the web holding device, and the web is threaded as a single thickness through the winder, whereat the web is unwound from the jumbo roll.

A further object of the invention is to provide an improvement of the devices known in prior art. On the other hand, the device in accordance with the invention is mainly characterized in that the device includes a web holding device, which is fitted so as to receive the web transferred by the fetching and grasping device and to hold the web, and a threading member carried by a carrier device, which is fitted so as to thread the web as a single thickness through the winder, whereat web is unwound from the jumbo roll.

By means of the method and the device in accordance with the invention, a number of remarkable advantages are obtained. The end of the web does not have to be torn to wedge-shaped form, whereby the threading of the web at full width makes the threading considerably faster. Also, the method and the device of the invention make the threading of the web faster because the slow tearing off of the wedge-shaped end of the web is avoided. Likewise, the auxiliary equipment for threading, such as air blowers and belts, can be omitted. Also, the method and the device of the invention permit threading of the web by one worker alone and, yet, relatively rapidly. The method and the device of the invention also produce economies of material, because no paper broke is formed.

The most highly recommended fields of application of the method and the device of the invention are winders in which the time of threading of the web is long and which require a great deal of labour, such as coating machines, calenders, and slitter-winders. The method of the invention can be applied both when running the upper way and when running the lower way.

The invention will be described in detail with reference to some preferred embodiments of the invention illustrated in the figures in the accompanying drawings, whereat the invention is, however, not to be confined to said embodiments alone.

Figure 1:
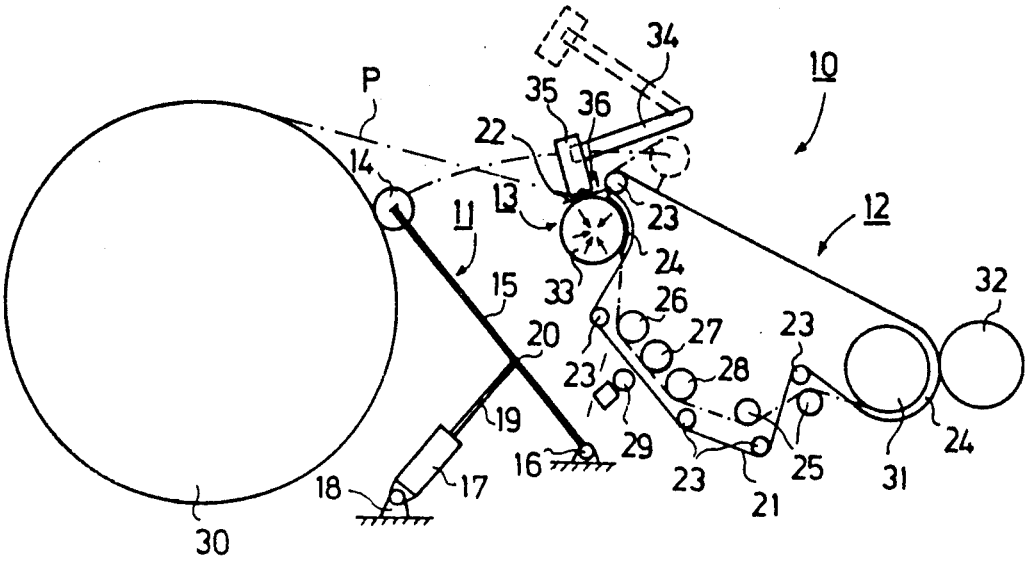
FIG. 1 is a side view of an advantageous embodiment of a device intended for carrying out the method of the invention, wherein the end of the web has been fetched from the jumbo roll by means of the fetching and grasping device.

In the embodiment shown in FIG. 1, the device in accordance with the invention is denoted generally with the reference numeral 10. In this embodiment, the device 10 includes a fetching and grasping device 11, a carrier device 12, and a web holding device 13. In the embodiment of FIG. 1, the method and the device of the invention are applied to a slitter-winder, whose rear carrier roll is denoted with the reference numeral 31 and the front carrier roll with the reference numeral 32. The jumbo roll is denoted with the reference numeral 30, and the web unwound from the jumbo roll 30 with the letter P.

In the embodiment of FIG. 1, the fetching and grasping device 11 consists of a suction roll 14, an arm 15 being fitted to displace said roll 14 by means of a cylinder 17. The articulation point of the arm 15 is denoted with the reference numeral 16, the fastening bracket of the cylinder 17 with the reference numeral 18, the piston of the cylinder 17 with the reference numeral 19, and the articulation point of the piston 19 with the reference numeral 20.

In the embodiment of FIG. 1, the carrier device 12 consists of chains 21, whose number is two in this embodiment. The guide rolls of the chains 21 are denoted with the reference numeral 23. A threading member 22 is fitted on the chains 21. The glide guides of the chains 21 are denoted with the reference numeral 24. Spreading members for the web P to be threaded are denoted with the reference numeral 25, and the knife board of the slitter-winder with the reference numerals 26 to 29. In the way known in itself, the knife board consists of the rolls 26 and 28, of the lower knife 27, and the upper knife 29.

In the embodiment of FIG. 1, the web (P) holding device 13 consists either of a suction roll 33 alone, or alternatively of an ordinary (non-suction) roll 33 and a beam 35, which is fitted above said roll 33 at the opposite side of the web P and attached to an arm 34 that is fitted pivotably. In the embodiment of FIG. 1, the beam 35 is provided with a cutter blade 36. The web P may, of course, also be cut off manually or by means of some other cutter solutions in themselves known.

The device shown in FIG. 1 operates as follows. The web P is fetched from the jumbo roll 30 by means of the suction roll 14 and is transferred to the web holding device 13, in other words, in the present embodiment, onto the suction roll 33. Next, the web P is attached to the holding device 13, in this embodiment by switching on the suction to the suction roll 33. Next, the web P is detached from the fetching and grasping device 11, in this embodiment from the suction roll 14. In this embodiment, the detaching takes place simply so that the end of the web P is cut-off by means of the cutter blade 36, whereby the web P is released from the grip of the suction roll 14. Hereupon the end of the web P is attached to the threading member 22. This may take place, e.g., in a way in itself known by using a tape, preferably a two-sided tape, which is attached to the threading member 22, whereby the end of the web P, of course, adheres to the threading member 22. Next, the web P is detached from the web P holding device 13, in this embodiment by switching the suction off the suction roll 33. Finally the web P attached to the threading member 22 is passed as a single thickness through the slitter-winder, being carried by the carrier device 12, whereby, during the threading, web P is unwound from the jumbo roll 30.

In an alternative embodiment in accordance with FIG. 1, the procedure is substantially similar to that described above, but the web P is held by means of pressing produced by an ordinary roll 33 and a beam 35. Thus, in this alternative embodiment, suction is required in the suction roll 14 alone.

Figure 2:
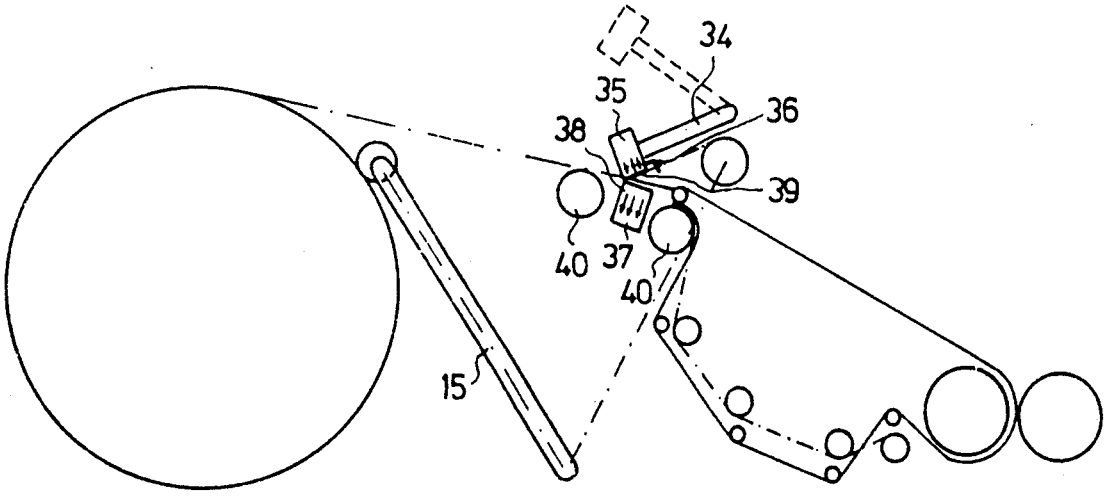
FIG. 2 is a side view of a second advantageous embodiment of a device intended for carrying out the method of the invention, wherein the end of the web has been fetched from the jumbo roll by means of the fetching and grasping device.

The embodiment shown in FIG. 2 is in the other respects the same as that shown in FIG. 1, but in the embodiment of FIG. 2 the web P holding device 13 consists of a beam 37 provided with a suction plane 38. If desired, above the beam 37, at the opposite side of the web P, it is possible to provide a beam 35 attached to an arm 34 that is fitted pivotably, which said beam 35 may, in this embodiment, also be provided with a suction plane 39. The suction plane 39 is, however, not essential. In the other respects, in the device in accordance with FIG. 2, the procedure in the threading of the web P corresponds to that in the embodiment of FIG. 1. The reference numeral 40 refers to the web P alignment rolls.

If desired, in the method of the present invention, it is possible to proceed partly in a way corresponding to the method of the Finnish Patent No. 69,439, in other words, it is possible to wind a desired number of windings around the fetching and grasping device 11, i.e. around the suction roll 14. This is, however, only an alternative possibility, but such winding-around is not necessary, whereas it is necessary in the method of the Finnish Patent No. 69,439.

Above, only some advantageous embodiments of the invention are described, and it is evident for a person skilled in the art that numerous modifications can be made to them within the scope of the inventive idea defined in the accompanying claims.

What is claimed is:

1. A method for threading the end of a web from a jumbo roll or the like along a selected path through a web processing arrangement, comprising:
   (a) grasping the end of the web on the roll,
   (b) transferring the end of the web by a fetching and grasping device to a position such that the web extends adjacent a web holding device,
   (c) holding the web by the web holding device,
   (d) detaching the web from the fetching and grasping device, attaching the web to a threading member, and releasing the web from the web holding device, and
   (e) advancing the threading member along the selected path.

2. A method according to claim 1, comprising, in step (c), holding the web by the web holding device at a location spaced apart along the web from the end of the web.

3. A method according to claim 2, wherein the step of detaching the web from the fetching and grasping device comprises cutting the web between said location and the end of the web, whereby a new web end is formed.

4. A method according to claim 3, wherein the step of attaching the web to the threading member is performed after cutting the web.

5. A method according to claim 1, wherein step (a) comprises grasping the end of the web by suction.

6. A method according to claim 1, wherein step (c) comprises holding the web by suction.

7. A method according to claim 1, wherein step (c) comprises holding the web by gripping.

8. Apparatus for threading the end of a web from a jumbo roll or the like along a selected path through a web processing arrangement, comprising:
   a web holding device operative selectively to hold the web or release the web,
   a fetching and grasping device for grasping the end of the web on the roll,
   transfer means for causing the fetching and grasping device to transfer the end of the web to a position such that the web extends adjacent the web holding device, so that the web holding device may be operated to hold the web, a threading member, means for advancing the threading member along the selected path, and means for attaching the threading member to the web when it is held by the web holding device, so that when the web holding device is operated to release the web and the threading member is advanced, the web is threaded through the web processing arrangement as a single thickness and the web is unwound from the jumbo roll.

9. Apparatus according to claim 8, wherein the fetching and grasping device comprises an arm that is pivotally mounted with respect to the jumbo roll, and a suction roll supported by the arm, and the transfer means comprise an actuator member which acts upon the arm to move the suction roll along a predetermined path of movement towards and away from the jumbo roll.

10. Apparatus according to claim 8, wherein the web holding device comprises a suction roll.

11. Apparatus according to claim 10, comprising an arm that is pivotable relative to the suction roll, and a beam that is attached to the arm for pivotal movement relative to the suction roll.

12. Apparatus according to claim 8, wherein the web holding device comprises first and second press members for gripping the web therebetween.

13. Apparatus according to claim 12, wherein the first press member is stationary with respect to translation relative to the jumbo roll, and the apparatus comprises an arm that is pivotable relative to the first press member, and the second press member is attached to the arm for pivotal movement relative to the first press member.

14. Apparatus according to claim 12, wherein the first press member is a suction member and the second press member is a beam.

15. Apparatus according to claim 8, wherein the web holding device comprises a beam having a suction plane.

16. Apparatus according to claim 15, comprising an arm that is pivotable relative to the beam, and a second beam that is attached to the arm for pivotal movement relative to the first-mentioned beam.

17. Apparatus according to claim 16, wherein the second beam has a suction plane.

18. Apparatus according to claim 8, comprising a blade attached to the web holding device for cutting the web at a position on the opposite side of the web holding device from the jumbo roll.

19. Apparatus according to claim 8, wherein the means for advancing the threading member comprise a carrier device for guiding the threading member along said selected path.

20. Apparatus according to claim 19, wherein the carrier device comprises chains on which the threading member is fitted.

* * * * *